US008281957B2

(12) United States Patent
Farmer

(10) Patent No.: US 8,281,957 B2
(45) Date of Patent: Oct. 9, 2012

(54) HOT LATHER DISPENSER

(76) Inventor: Calvin Ree Farmer, Memphis, TN (US)

( * ) Notice: Subject to any disclaimer, the term of this patent is extended or adjusted under 35 U.S.C. 154(b) by 1128 days.

(21) Appl. No.: 12/156,742

(22) Filed: Jun. 4, 2008

(65) Prior Publication Data

US 2009/0014472 A1 Jan. 15, 2009

Related U.S. Application Data

(60) Provisional application No. 60/937,083, filed on Jun. 4, 2007.

(51) Int. Cl.
*B67D 7/82* (2010.01)

(52) U.S. Cl. ..... 222/146.5; 222/132; 222/135; 219/214

(58) Field of Classification Search ..... 222/129, 222/132, 135, 146.2, 146.5, 180, 182, 183; 401/1, 2; 219/214
See application file for complete search history.

(56) References Cited

U.S. PATENT DOCUMENTS

| | | | | |
|---|---|---|---|---|
| 3,222,500 | A * | 12/1965 | Small et al. | 392/451 |
| 3,682,356 | A * | 8/1972 | Karle | 222/132 |
| 3,749,880 | A * | 7/1973 | Meeks | 219/214 |
| 4,932,563 | A * | 6/1990 | Diamond et al. | 222/129 |
| 4,941,597 | A * | 7/1990 | Lopez et al. | 222/146.5 |
| 5,862,947 | A * | 1/1999 | Wiegner et al. | 222/82 |
| 6,454,127 | B1 * | 9/2002 | Suomela et al. | 222/54 |
| 7,288,745 | B2 * | 10/2007 | Colonna | 219/439 |
| 2008/0041233 | A1 * | 2/2008 | Bunn | 99/281 |
| 2008/0083779 | A1 * | 4/2008 | Saravanane et al. | 222/129 |

* cited by examiner

*Primary Examiner* — J. Casimer Jacyna
(74) *Attorney, Agent, or Firm* — Charles F. Rye

(57) ABSTRACT

A device for holding containers and warming their contents. The containers are removably attached to the cover of the device by a neck which accommodates a dispenser pump. The containers hold substances such as creams, pastes, gels, lotions and the like especially, shaving cream liquid solution. The temperature of the device can be preset or adjustable. Timers can select the time of day to begin and end the heat cycle. Visual and/or audio indicators can be activated to indicate the substances are at the desired temperature. The device cover may include a scupper ledge contain any spillage from the dispenser pump.

5 Claims, 3 Drawing Sheets

HOT LATHER DISPENSER

SUMMARY OF THE INVENTION

Heated dispensers for personal care fluids and creams and especially shaving lather are old in the art. An electrically heated shaving mug was patented by at least 1919. Providing heat for shaving lather has followed the progression of advances in convenience to the user through the years including providing heat to aerosol can shaving creams either directly to the can or to the lather as it is used. Professionals certainly prefer heated lather as it is soothing to the client, better prepares the hair and skin for shaving and it is just plain expected.

Some hot lather dispensers that are currently utilized have draw backs of requiring mixing of the shaving cream base and water, open reservoir and require careful placement in the work area because of their shape and location of the dispenser nozzle. There are also problematic with leaks and spills that tend to attract pests. The current invention provides a stable receptacle with thermostatically controlled heat. A thermostat by definition reacts to a change in temperature and in turn alters controls. The user would select the desired temperature within predefined limits and the thermostat will vary power to the electric heat source until the detected actual temperature of the device matches the selected temperature. The heat control thermostat may be fixed at 110 degrees Fahrenheit or most likely user adjustable above that temperature. The shaving cream fluid containers are suspended by their necks through the cover which will also have an insulated exterior. The necks of the containers accommodate dispenser pumps that create shaving cream foam from a liquid during the pumping action. If variations of shaving cream are desired including, but not limited to, fragrance the containers will be shaped to nest together and still provide for efficient use of the interior volume of the heated receptacle with its cover in place. This also accommodates heated fluids, creams and gels other than shaving cream. The necks on the containers will be positioned such that the fluid weight tends to pull on the neck and suspend the container in a substantially vertical position in order that they nest properly which promotes easy installation and removal of the container group suspended from the cover and maintains the a gap between the containers and the heated wall or base of the receptacle. The vertical pull on the neck also keeps the container in a proper position for use even if the user decides to operate the dispenser with less than to total number of containers it may hold. Also included is a plug(s) to close unused apertures. The cover will have apertures concomitant with the neck position of the containers as nested together from one aperture in the center for a single container to a uniform ring of apertures which accommodate a group of containers which resemble a sliced pie when viewed from the top. Other variations of the containers may include a major volume container with a minor volume container nested in a vertical pocket in the upper surface of the major volume container and a complementary aperture pattern in the cover. A variation of the cover is also provided for that has an outer scupper ledge to catch any drips from the dispenser pumps or outlets. The upper portion of the receptacle will have a horizontal bearing ledge area with a concomitant horizontal bearing surface on the lower side of the cover which will slide-ably engage each other and allow rotation of the cover. In a more advanced version bearing may be mounted to said container bearing ledge. Bulk fluids may be sold with a new pump which is clearly marked to identify the products in each container loaded in the receptacle.

Add on digital devices are well know to be incorporated on a multitude of useful item. As with many others, this invention can be modified with electronics for the convenience of the user. Professionals and even consumers would want to have the product heated and ready to go by the time of its first expected daily use and also automatically shut down and also provide programmable weekly schedules. This is easily accomplished by off the shelf controllers. Another useful feature would be one or more programmable start/stop timers that give a signal to end any timed activities. The controller may also be adaptive for any data communication for information or control of itself or other devices by way of hard wire interconnects or remote communication systems. The current invention includes a controller which may be timed, multi-function timers and a communication port(s).

DETAILED DESCRIPTION OF THE DRAWINGS

Figure 1:
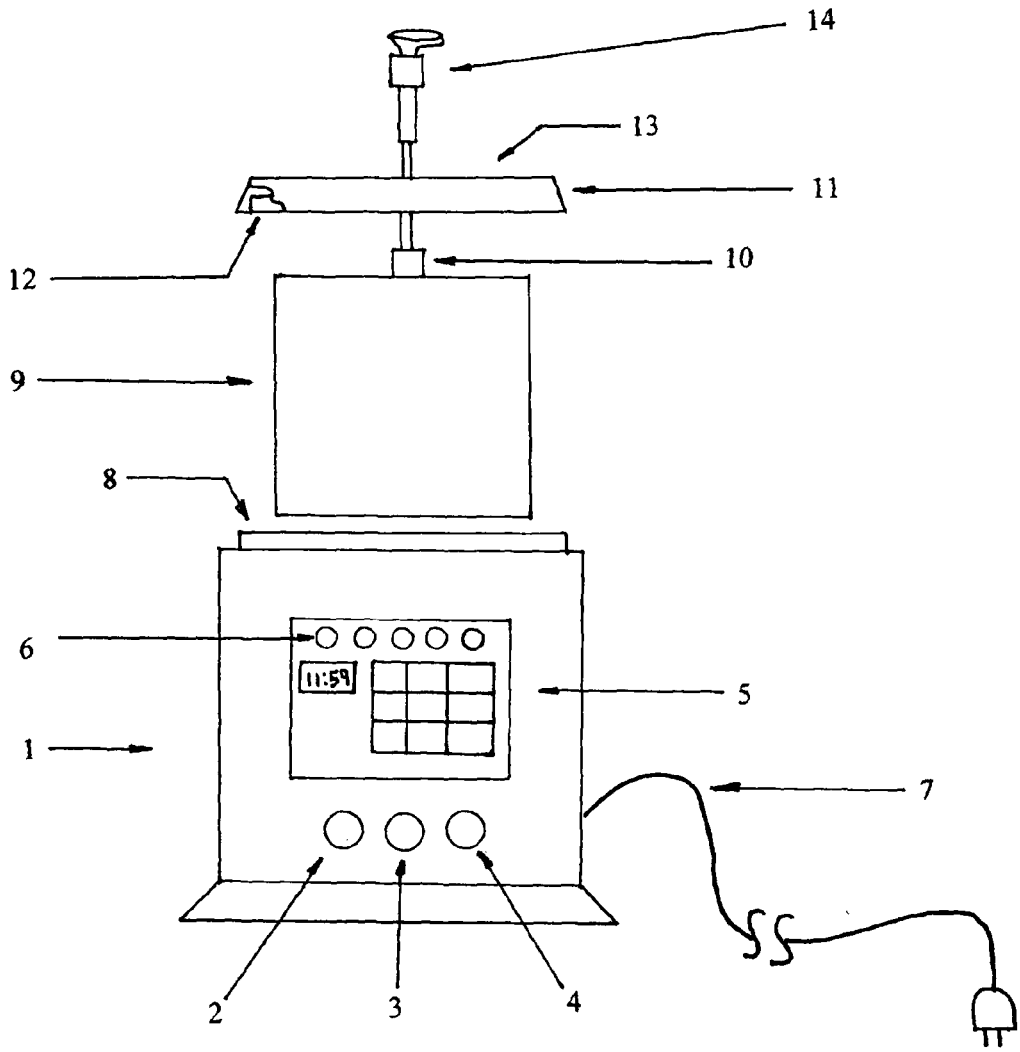
FIG. 1. Shows the receptacle, container, lid and dispenser pump.

FIG. 1. Shows front views of heated receptacle 1 with power indicator light 2, thermostat 3, temperature light 4, controller 5, start/stop timers 6, power plug 7 and bearing ledge 8. Container 9 is shown with neck 10. Single container cover 11 is shown with bearing surface 12 and aperture 13. Neck 10 is passed through aperture 13 and dispenser pump 14 is threaded to neck 10 and container 9 attached to cover 11 which is lowered into receptacle 1 contacting bearing ledge 8 and bearing surface 12.

Figure 2:
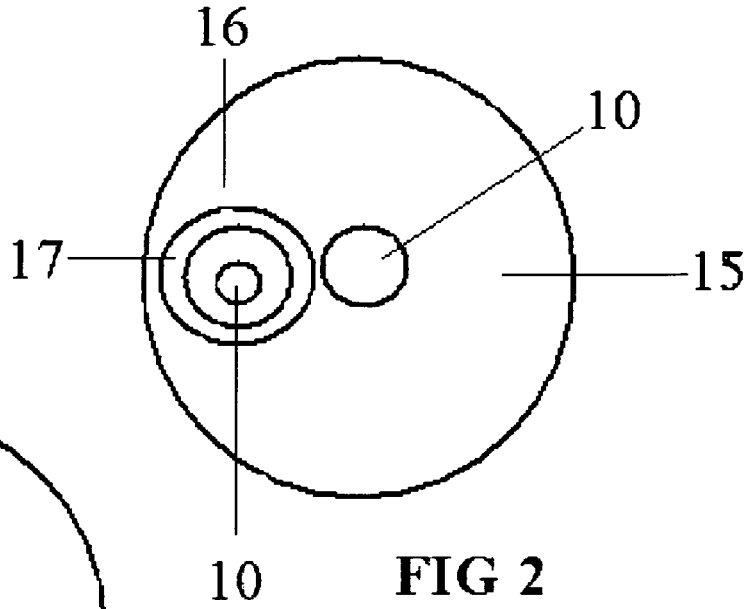
FIG. 2. Shows a major and nested minor container.

FIG. 2. Shows top views of major volume container 15 with neck 10 having a vertical pocket 16. Minor volume container 17 with neck 10 is nested inside vertical pocket 16.

Figure 3:
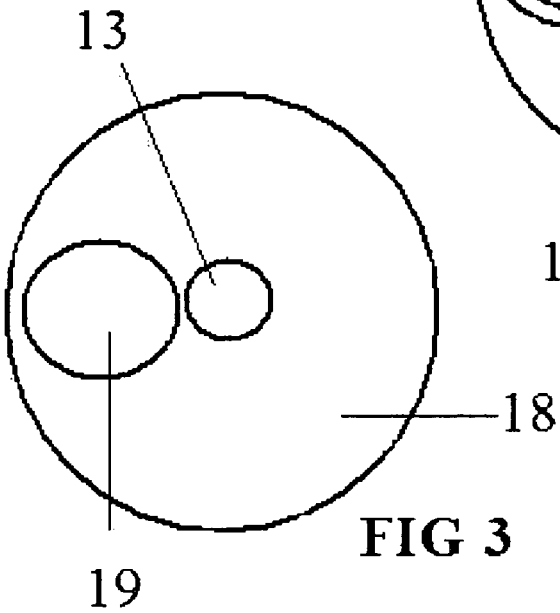
FIG. 3. Shows a cover having apertures.

FIG. 3. Shows a top view of cover 18 having apertures 13 and 19.

Figure 4:
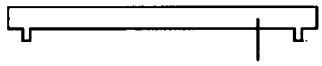
FIG. 4. Shows a plug for the minor container aperture.

FIG. 4. Shows a cutaway view of plug 20 which fits into cover aperture 19. Plug 20 is solid to entirely block cover aperture 19.

Figure 5:
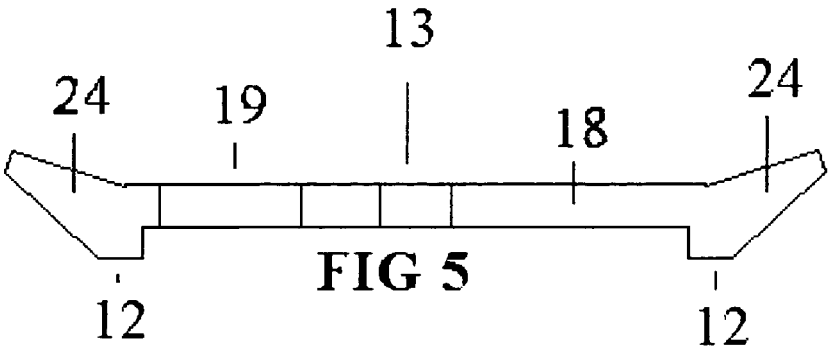
FIG. 5. Shows a cover with a scupper lip.

FIG. 5. Shows a cross section of cover 18 having scupper ledge 24 around its perimeter, bearing surface 12, aperture 13 and minor container aperture 19.

Figure 6:
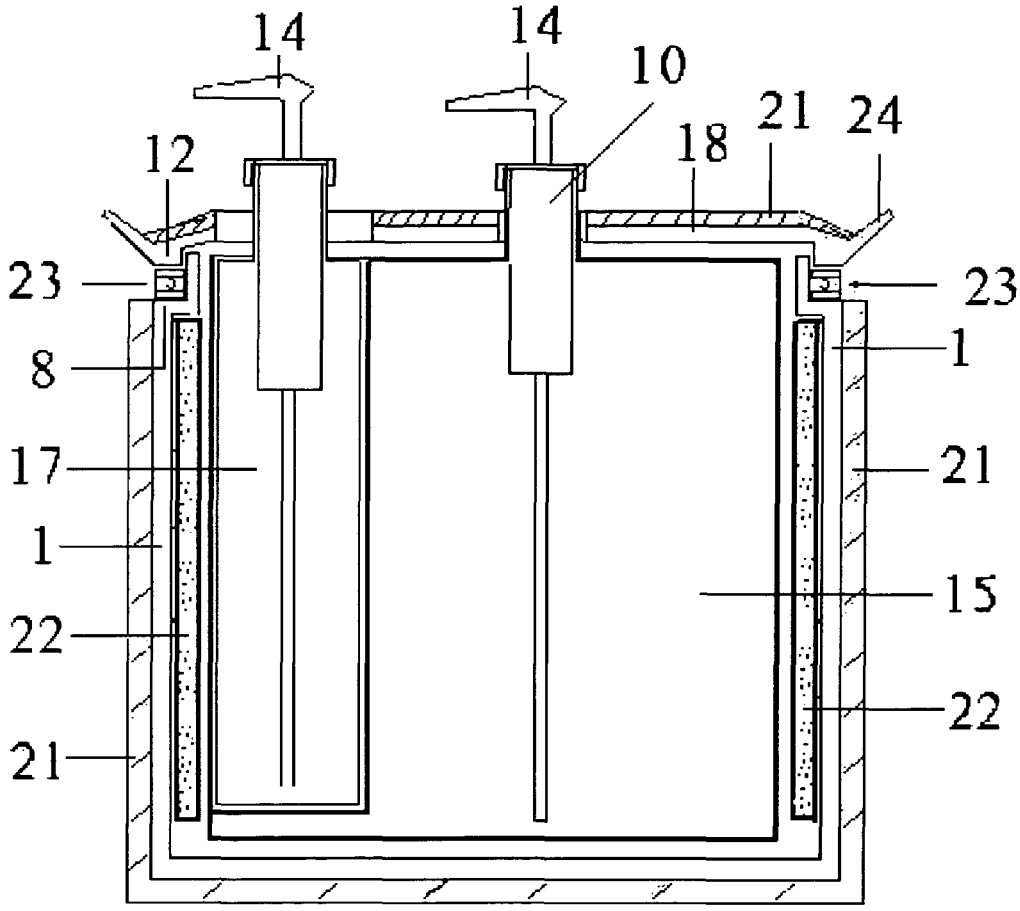
FIG. 6. Shows a cutaway view of the receptacle with electric heat source and a bearing on its bearing ledge and major and minor volume containers.

FIG. 6. Shows receptacle 1, having bearing ledge 8 on its uppermost region, with outer insulation 21 and electric heat source 22 surrounding its inner wall and controlled by controller 5 (FIG. 1.). Major container 15 is suspended by its neck 10 and secured by pump 14 on cover 18 having outer insulation 21. Minor container 17 may be independently removed from receptacle 1 through cover 18 by pulling the container upward. Bearing 23 is fitted around bearing ledge 8. Cover 18's bearing surface 12 is lowered into contact with bearing 23. And also shown is scupper ledge 24.

The specification and drawings of this application are intended to illuminate the invention and preferred embodiment without limitation upon the claims.

I claim:

1. A warmer device, comprising;

a receptacle having a substantially uniform cylindrical sidewall;

a cover defining at least two apertures;

a controllable heat source;

at least two fluid container(s) each defining at least one chamber having at least one neck per chamber on its upper region adaptable to pass through said cover aperture(s) and removable suspended by said cover;

one said container constituting a major volume and further defining at least one vertical pocket extending downward from its upper region;

at least one secondary container constituting a minor volume whose outer shape slideably fits into said pocket(s) of said major volume container;

said containers having at least one neck per chamber on its upper region positioned so that fluid weight in the container creates a substantially vertical pull on said neck (s);

said cover apertures of least a number equal to the number of said container necks and positioned concomitant with the neck(s) of the major and minor containers;

at least one plug adaptive to fill any unused cover apertures; and a dispenser pump adaptable to each said container neck.

2. The device of claim 1 further comprising;

said receptacle having an insulated exterior;

said cover having an insulated exterior;

said heat source power being electricity; and said fluid container(s) being substantially the volume of but, not in contact with, said receptacle interior with said cover fitted but not in contact with said receptacle to said receptacle.

3. The device of claim 1 further comprising:

said receptacle's upper region defining a lip comprising a horizontal bearing surface; and said cover's outer perimeter rotatably slideably concomitant with said bearing surface and said cover further defining depressions in its upper surface convenient for human grasp to rotate said cover.

4. The device of claim 1 further comprising:

said receptacle's upper region defining a lip comprising a bearing ledge;

a bearing adaptive to removeably fit on said bearing ledge; and said cover's outer perimeter slideably concomitant with said bearing and said cover further defining turning indentations in its upper surface convenient for human grasp to rotate said cover.

5. A warmer device, comprising;

a receptacle having substantially uniform cylindrical sidewall, an insulated outer surface, a thermostatic regulated electric heat source mounted within said outer surface, power and temperature indicators and an upper lip defining a horizontal bearing surface;

said thermostat controllable at and above 110 degrees Fahrenheit;

an insulated cover defining at least two apertures and its outer perimeter slideably concomitant with said bearing surface and having a circumferential upward sweeping scupper ledge extending beyond it's outer perimeter;

a bearing adaptive to removeably fit on said bearing ledge;

at least two fluid containers each defining at least one chamber having a neck per chamber on its upper region;

one said container constituting a major volume and further defining at least one vertical pocket extending downward from its upper region;

at least a second container constituting a minor volume whose outer shape slideably fits into said pocket(s) of said major volume container;

said containers having at least one neck per chamber on its upper region positioned so that fluid weight in the container tends to create a vertical pull on said neck(s);

said fluid container(s) being substantially the volume of but, not in contact with, said receptacle interior with said cover fitted to said receptacle;

said apertures at least positioned concomitant with the neck(s) of the major and minor containers;

a dispenser pump adaptable to each said container neck; and at least one plug adaptive to fill any unused cover apertures.

* * * * *